US011261834B2

(12) United States Patent
Schürz et al.

(10) Patent No.: US 11,261,834 B2
(45) Date of Patent: Mar. 1, 2022

(54) ANTI-REFLECTION DEVICE FOR FUEL INJECTION VALVE AND FUEL INJECTION VALVE

(71) Applicant: Vitesco Technologies GMBH, Hannover (DE)

(72) Inventors: Willibald Schürz, Pielenhofen (DE); Stefano Filippi, Castel' Anselmo Collesalvetti (DE); Michael J. Hornby, Williamsburg, VA (US)

(73) Assignee: Vitesco Technologies GMBH, Regensburg (DE)

( * ) Notice: Subject to any disclaimer, the term of this patent is extended or adjusted under 35 U.S.C. 154(b) by 44 days.

(21) Appl. No.: 16/847,007

(22) Filed: Apr. 13, 2020

(65) Prior Publication Data

US 2020/0240378 A1 Jul. 30, 2020

Related U.S. Application Data

(63) Continuation of application No. PCT/EP2018/076744, filed on Oct. 2, 2018.

(30) Foreign Application Priority Data

Oct. 13, 2017 (EP) ..... 17196340

(51) Int. Cl.
*F02M 55/04* (2006.01)
*F02M 51/06* (2006.01)

(52) U.S. Cl.
CPC ..... *F02M 55/04* (2013.01); *F02M 51/0671* (2013.01); *F02M 2200/315* (2013.01);
(Continued)

(58) Field of Classification Search
CPC ..... F02M 55/04
See application file for complete search history.

(56) References Cited

U.S. PATENT DOCUMENTS 3,159,349 A * 12/1964 Crocco ..... F02M 55/02 239/453
4,526,151 A * 7/1985 Tateishi ..... F02M 55/02 123/468

(Continued)

FOREIGN PATENT DOCUMENTS

CN 103261663 A 8/2013
CN 103261664 A 8/2013

(Continued)

OTHER PUBLICATIONS

International Search Report and Written Opinion dated Dec. 11, 2018 from corresponding International Patent Application No. PCT/EP2018/076744.

(Continued)

*Primary Examiner* — Thomas N Moulis

(57) ABSTRACT

An anti-reflection device for preventing the reflection of pressure waves inside a fuel injection valve. The anti-reflection device includes an essentially cylindrical base body with a first base side, a second base side, and an outer surface. The anti-reflection device also includes a longitudinal axis orientated parallel to a propagation direction of a pressure wave. The longitudinal axis penetrating the first base side and the second base side. The anti-reflection device also includes a flow path for fuel formed between the first base side and the second base side. The flow path forming a curve around the longitudinal axis.

14 Claims, 5 Drawing Sheets

(52) U.S. Cl.
CPC ..... *F02M 2200/9015* (2013.01); *F02M 2200/9053* (2013.01)

(56) References Cited

U.S. PATENT DOCUMENTS

| | | | | |
|---|---|---|---|---|
| 6,019,128 | A * | 2/2000 | Reiter | F02M 61/165 137/549 |
| 6,629,650 | B2 * | 10/2003 | Curran | F02M 51/0664 239/533.1 |
| 6,676,044 | B2 * | 1/2004 | Dallmeyer | F02M 51/005 239/585.1 |
| 6,745,798 | B2 * | 6/2004 | Kilgore | F02M 55/04 138/30 |
| 7,093,584 | B1 * | 8/2006 | Potter | F02M 55/04 123/447 |
| 9,556,842 | B2 | 1/2017 | Kobayashi et al. | |
| 10,731,614 | B2 | 8/2020 | Filippi | |
| 10,975,821 | B2 * | 4/2021 | Jovovic | F02M 21/0263 |
| 2002/0000216 | A1 | 1/2002 | Ismailov | |
| 2005/0269426 | A1 * | 12/2005 | Cho | F02M 51/0682 239/533.2 |
| 2005/0269428 | A1 * | 12/2005 | Cho | F02M 65/00 239/533.2 |
| 2005/0269431 | A1 * | 12/2005 | Cho | F02M 61/166 239/585.1 |
| 2008/0127941 | A1 | 6/2008 | Iben et al. | |
| 2009/0050111 | A1 * | 2/2009 | Cora | F02M 55/025 123/456 |
| 2010/0012091 | A1 | 1/2010 | Kannan et al. | |
| 2013/0256429 | A1 | 10/2013 | Kobayashi et al. | |
| 2013/0270368 | A1 | 10/2013 | Kobayashi et al. | |
| 2013/0327851 | A1 | 12/2013 | Kobayashi et al. | |
| 2014/0345448 | A1 | 11/2014 | Vidal et al. | |
| 2017/0328325 | A1 * | 11/2017 | Scheffel | F02M 61/166 |
| 2020/0248661 | A1 * | 8/2020 | Kanegae | F02M 55/00 |
| 2020/0256294 | A1 * | 8/2020 | Takimoto | F02M 55/004 |

FOREIGN PATENT DOCUMENTS

| | | | |
|---|---|---|---|
| CN | 103392065 | A | 11/2013 |
| CN | 104114847 | A | 10/2014 |
| CN | 106460760 | A | 2/2017 |
| CN | 108138715 | A | 6/2018 |
| DE | 102004056414 | A1 | 5/2006 |
| EP | 2333297 | A1 | 6/2011 |
| EP | 2657507 | A1 | 10/2013 |
| EP | 2657508 | A1 | 10/2013 |
| EP | 2679800 | A1 | 1/2014 |
| EP | 2816218 | A1 | 12/2014 |
| JP | H09112380 | A | 4/1997 |
| JP | H812229 | | 12/2014 |
| KR | 2012 0038574 | A | 10/2010 |
| KR | 20120038574 | A | 4/2012 |
| WO | 2017063977 | | 12/2014 |
| WO | 2015183423 | A1 | 12/2015 |

OTHER PUBLICATIONS

EP Search Report dated Mar. 12, 2018 from corresponding European Patent Application No. 17196340.8.
Korean Office Action dated May 23, 2021 for corresponding Korean Patent Application No. 10-2020-7013111.
Chinese Office Action dated May 11, 2021 for corresponding German Patent Application No. 201880066761.3.

* cited by examiner

ANTI-REFLECTION DEVICE FOR FUEL INJECTION VALVE AND FUEL INJECTION VALVE

CROSS-REFERENCE TO RELATED APPLICATIONS

This application claims the benefit of International Application No. PCT/EP2018/076744, filed Oct. 2, 2018, which claims priority to European Application No. EP 17196340.8, filed Oct. 13, 2017. The disclosures of the above applications are incorporated herein by reference.

TECHNICAL FIELD

The disclosure relates to an anti-reflection device for preventing the reflection of pressure waves inside a fuel injection valve. The disclosure further relates to a fuel injection valve with an anti-reflection device.

BACKGROUND

An injection valve for injecting fuel directly or indirectly into the combustion chamber of a vehicle is disclosed in document EP 2 333 297 B1. One typical problem of such injection valves, in particular high-pressure valves, is the generation of pressure waves or pressure pulsations caused by an injection event. Internal pressure pulsations cause problems for multiple injection applications, because when pressure conditions inside the injector are not stable or not known at the time of opening of the valve, the amount of injected fuel cannot be controlled.

Reopening of the valve out of control causes tip wetting and combustion problems, which increase the emission of particles. Furthermore, growing of particles sticking on the tip of the injector affect the performance of the injector.

SUMMARY

The disclosure provides an anti-reflection device and an injection valve that blocks pressure waves, for example, pressure waves coming from the rail, from propagating inside the injector.

One aspect of the disclosure provides an anti-reflection device for preventing the reflection of pressure waves inside a fuel injection valve. The expression "for preventing the reflection of pressure waves" shall also encompass examples in which reflections of pressure waves are not completely suppressed, but in particular only largely reduced.

The anti-reflection device includes an essentially cylindrical base body with a first base side, a second base side and an outer surface. The outer surface extends from the first base side to the second base side—for example, along the cylinder axis of the base body—and may expediently connect the first and second base sides to one another. The anti-reflection device further includes a longitudinal axis L intended to be orientated parallel to a propagation direction of a pressure wave, the longitudinal axis penetrating the first base side and the second base side. In some examples, the longitudinal axis is parallel—for example, coaxial—to the cylinder axis of the base body. The anti-reflection device further includes a flow path for fuel which is formed between the first base side and the second base side, the flow path forming a curve around the longitudinal axis L. The cylindrical base body may have the flow path formed on its outer surface in some examples.

By an essentially cylindrical base body, it is understood that it is possible to fit the cylindrical base body into a cylindrical hollow body. In other words, the base body has a cylindrical basic shape. The base body may include a structured periphery, e.g. structured to shape the flow path. The envelope of the structured periphery also has a cylindrical shape.

This antireflection device has the advantage, that fuel coming from the first base side and flowing through the anti-reflection device towards the second base side is forced to take a curved path around the longitudinal axis L. This helps to dissipate energy and to dampen pressure pulsations.

If a pressure wave enters through the anti-reflection device and is reflected inside the injector, the pressure wave would encounter fuel entering through the anti-reflection device on the curved flow path and having rotational energy. If the reflected pressure wave would return through the anti-reflection device, it would have to overcome this rotational energy first and turn the direction of the current to re-enter the anti-reflection device. Thus, a large amount of energy would be dissipated. As a consequence, no stationary waves are formed inside the injector and pressure waves are dampened.

In some implementations, the flow path has the form of a helical curve around the longitudinal axis L. To put it differently, the flow path has a center line which is a helical curve around the longitudinal axis L, i.e. around the cylinder axis of the base body. This implementation has the advantage, that a helical curve may be formed easily on the anti-reflection device and that a helical curve would help to create a rotational flow of fuel.

In some examples, the base body has a cylindrical inner section and an outer section that includes a helically curving wall formed on a circumferential surface of the inner section and is arranged coaxially with the cylindrical inner section, the flow path formed by the circumferential surface of the inner section and two adjacent turnings of the wall. This example has the advantage, that the flow path can be created easily by forming a thread on the circumferential surface of the inner section. Such a thread is easy to manufacture.

In some implementations, the flow path has a cross-sectional area of 1 to 4 $mm^2$. With a cross-section of 1 to 4 $mm^2$ it is possible to achieve a negligible overall pressure drop across the anti-reflection device. The cross-section of the flow path may be adjusted to the discharge rate of the valve itself. For many types of valves, a cross-section of 3 to 4 $mm^2$ is suitable.

The base body may be formed of plastic material. Alternatively, it may be formed of a metal, for example stainless steel. The base body may be formed by injection molding.

In some examples, a hollow cone is formed in the base body coaxially with the base body and is orientated with its base plane forming a part of the first base side. This has the advantage that pressure waves can be reflected into the cone shape with a coefficient lower than 1 which improves the dampening of pressure waves. The hollow cone may have an angle of opening between 30° and 100°.

In some implementations, a fuel injection valve includes a valve body with a central longitudinal axis including a cavity with a fluid inlet portion and a fluid outlet portion. The fuel injection valve further includes a valve needle axially movable in the cavity, the valve needle preventing fluid flow through the fluid outlet portion in a closing position and releasing the fluid flow through the fluid outlet portion in further positions.

The injection valve further includes an electromagnetic actuator unit designed to actuate the valve needle.

Furthermore, the injection valve includes at least one antireflection device as described above being arranged inside the cavity, the first base side being directed towards the fluid inlet portion.

The fuel injection valve has the advantage, that pressure waves entering from the rail are dampened and prevented from being transmitted into the injector. Furthermore, the injector wet path can be considered decoupled from the rail, which improves the stability of pressure conditions inside the injector, thus avoiding reopening events of the valve. Additionally, the anti-reflection device can be useful to decouple the injector from noise generated by a fuel pump and the rail and other injectors.

The anti-reflection device may be arranged upstream of an armature of the electromagnetic actuator unit.

The anti-reflection device may be arranged close to the fluid inlet portion of the injector, thereby dampening pressure waves entering from the rail as early as possible.

In some implementations, the anti-reflection device is press-fitted into an inlet tube of the valve body. This has the advantage, that the anti-reflection device may be mounted easily.

The details of one or more implementations of the disclosure are set forth in the accompanying drawings and the description below. Other aspects, features, and advantages will be apparent from the description and drawings, and from the claims.

DESCRIPTION OF DRAWINGS

Like reference symbols in the various drawings indicate like elements.

DETAILED DESCRIPTION

Figure 1:
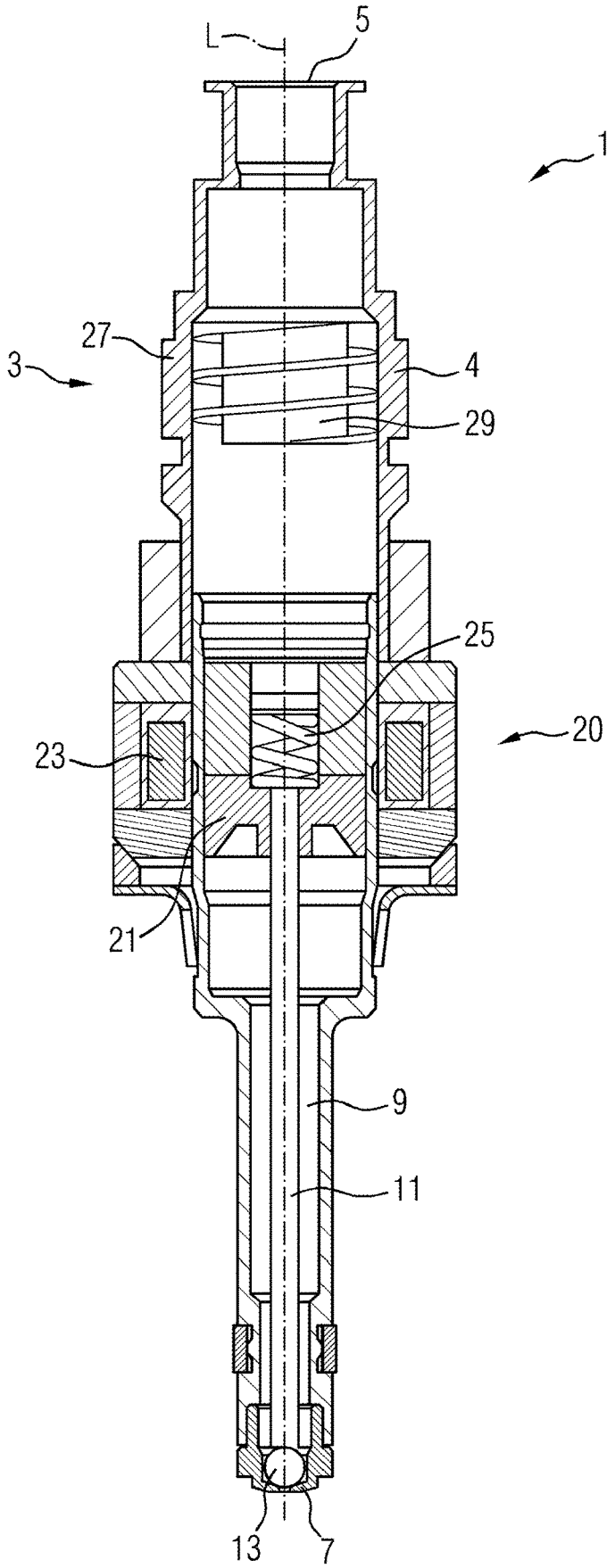
FIG. 1 shows a cross-section of an exemplary injection valve.

FIG. 1 shows an injection valve 1 for the injection of fuel into an internal combustion engine. The injection valve 1 includes a valve assembly 3 with a valve body 4 with a central longitudinal axis L. The valve body 4 includes a cavity 9 with a fluid inlet portion 5 and a fluid outlet portion 7.

A valve needle 11 is arranged axially movable in the cavity 9. The valve needle 11 prevents a fluid flow through the fluid outlet portion 7 in a closing position. To achieve this, the needle 11 has a ball 13 welded to its lower end which interacts with a valve seat (not shown in detail) of the valve body 4.

The injection valve 1 further includes an electromagnetic actuator unit 20 to actuate the valve needle 11. The actuator unit 20 includes an armature 21 which may be fixed to the needle 11 or coupled to the needle 11 in some other way to cause the needle 11 to move axially in the cavity 9 in response to a magnetic field. The actuator unit 20 further includes a coil 23 which may be energized to induce a magnetic field. The magnetic field acts on the armature 21 to cause it to travel upwards and take the needle 11 with it against the force of the calibration spring 25. Thus, the ball 13 leaves the valve seat and fuel is released through the fluid outlet portion 7.

When the magnetic field ceases, the valve needle 11 is moved downwards by the force of the calibration spring 25 and the fluid outlet portion 7 is closed again.

The cavity 9 has an upper part which is enclosed by the inlet tube 27. The inlet tube 27 is the part of the valve body 4 which is closest to the fuel inlet portion 5. In this part of the cavity 9, pressure pulsations coming from the rail and entering through the fluid inlet portion 5 propagate. To dissipate the energy of pressure pulsations and prevent pressure waves from being transmitted inside the injector 1, an antireflection device 29 is arranged in the cavity 9 and press-fitted into the inlet tube 27.

Details of the anti-reflection device 29 are shown in FIGS. 2 and 3.

Figure 2A:
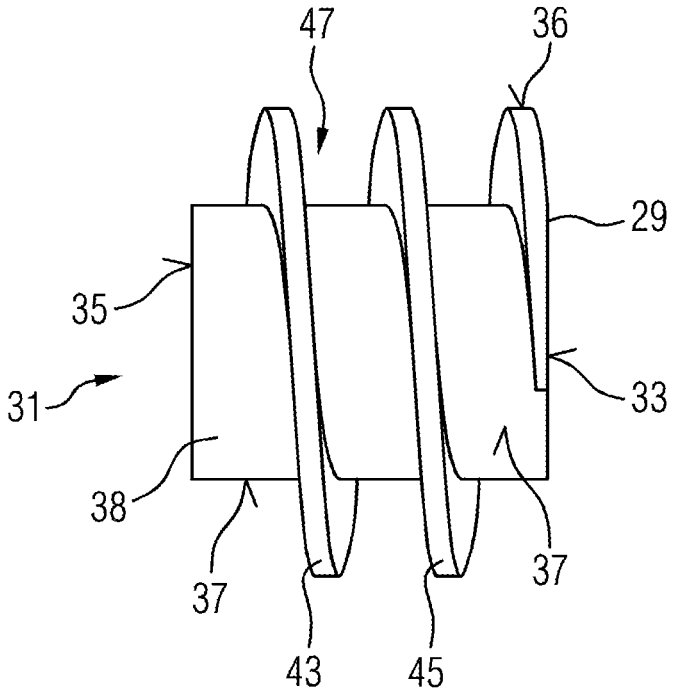
FIGS. 2*a*-2*d* show several views of an exemplary anti-reflection device.
Figure 2B:
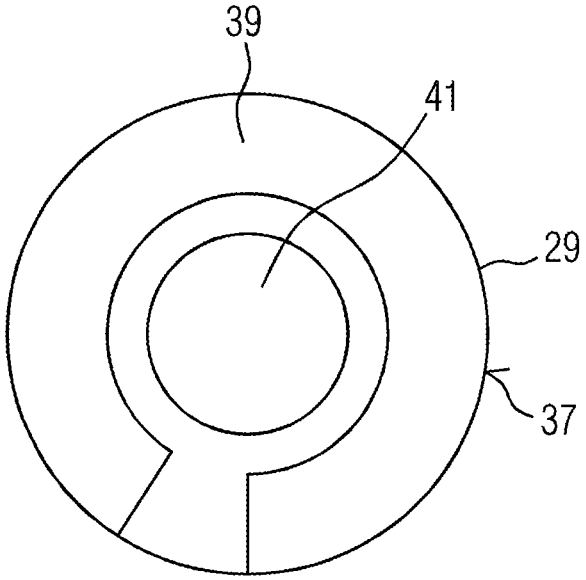
Figure 2C:
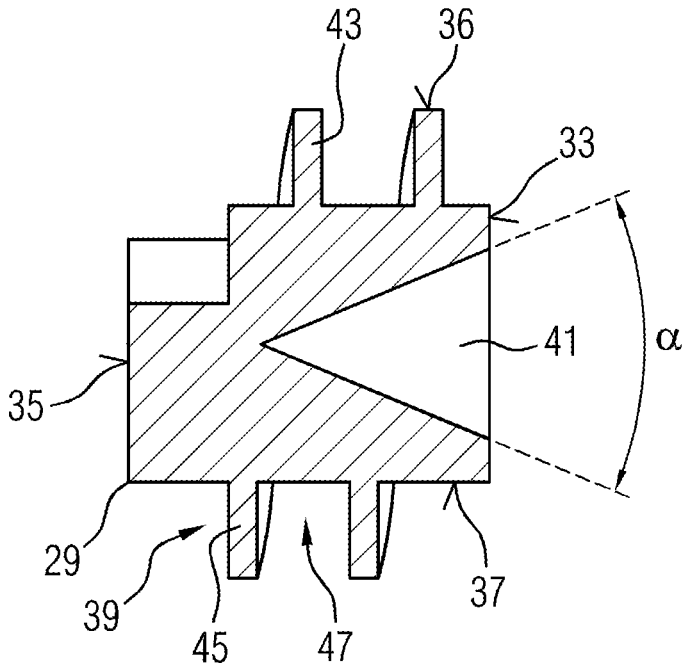
Figure 2D:
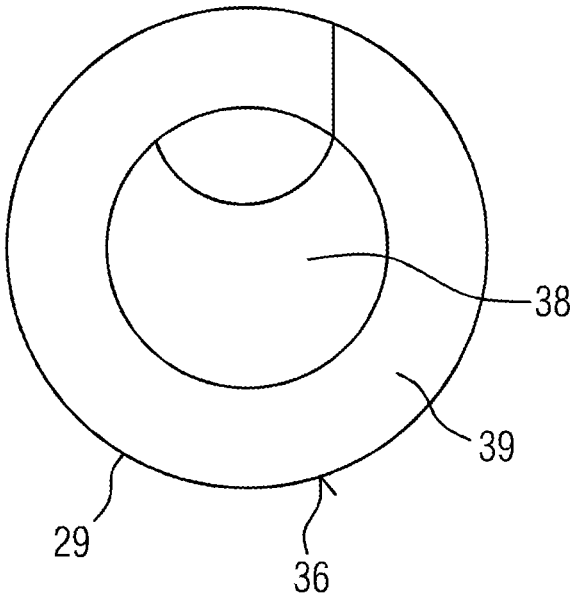
Figure 3A:
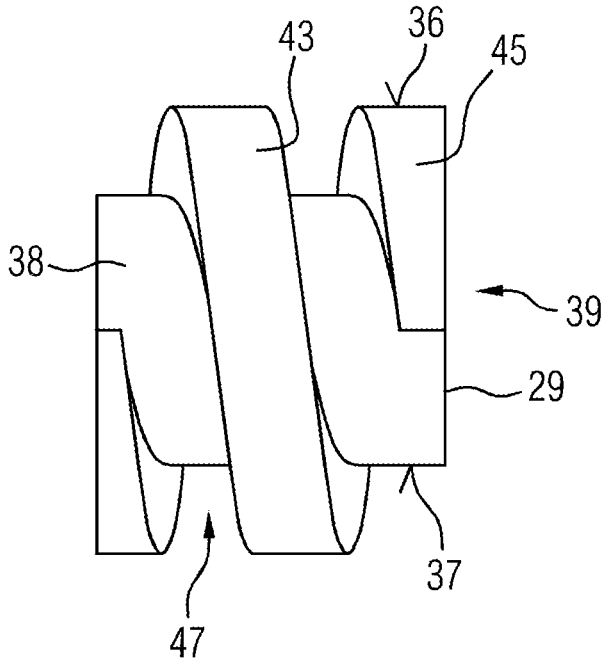
FIGS. 3*a*-3*d* show several views of an exemplary anti-reflection device.
Figure 3B:
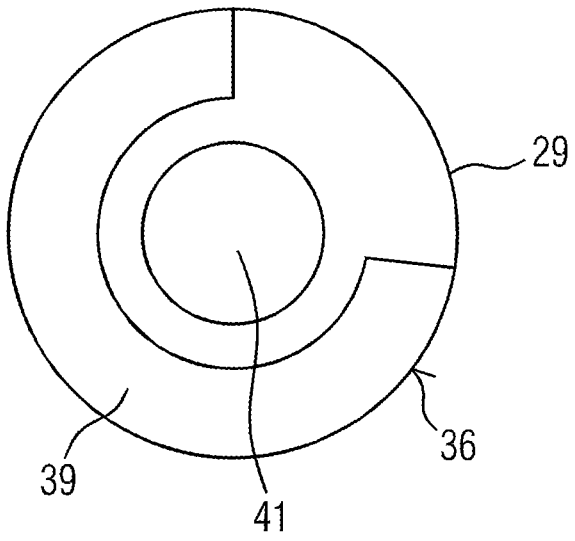
Figure 3C:
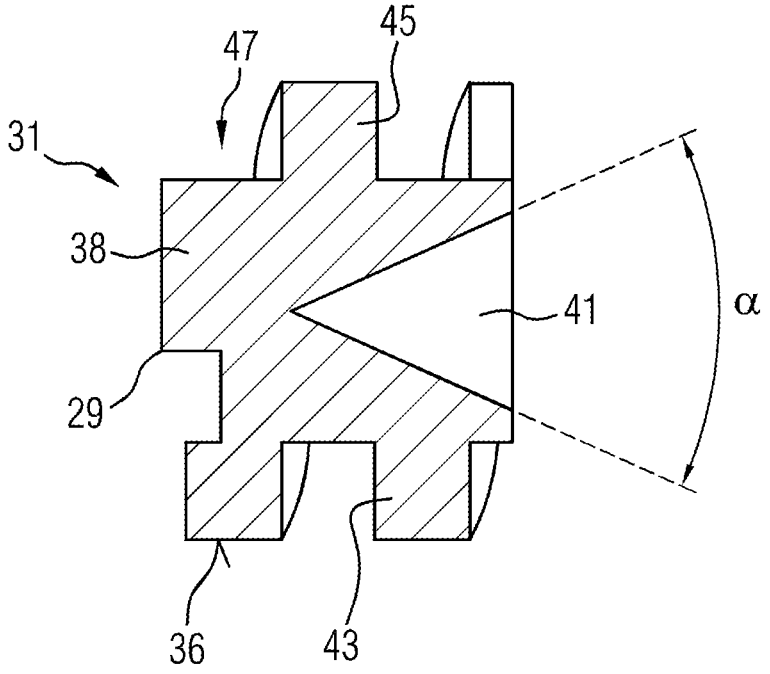
Figure 3D:
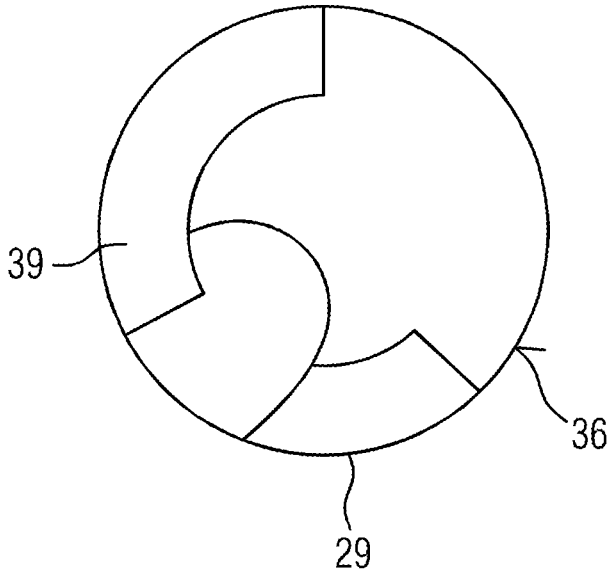

FIG. 2*a*) shows a side view of the anti-reflection device 29, FIG. 2*b*) shows the anti-reflection device 29 from above, FIG. 2*c*) shows a cross-section of the anti-reflection device 29 and FIG. 2*d*) shows a view of the anti-reflection device 29 from below.

The anti-reflection device 29 according to FIG. 2 is a first example and has a cylindrical base body 31 which is arranged coaxially with the valve body 4. The base body 31 has an inner section 38 and an outer section 39. The inner section 38 has the form of a cylinder with a circumferential surface 37. The circumferential surface 37 is, for example, an outer surface of the inner section 38 in this and other examples. The anti-reflection device 29 further includes a first base side 33 and a second base side 35 and an outer surface 36 of the base body 31.

On the outer surface 36 there is arranged a wall 45 forming a thread 43 on the circumferential surface 37. Thus, the wall 45 extends around the circumferential surface 37 in a helical curve and is arranged coaxially with the cylindrical inner section 38. Between single turns of the wall 45, a flow path 47 is formed for fuel entering the injector 1 through the fluid inlet portion 5. The flow path 47, which in this example has a square cross-section, has a cross-sectional area of 3 to 4 $mm^2$.

All fuel entering through the fluid inlet portion 5 and being intended to exit the injector 1 through fluid outlet portion 7 must pass through the flow path 47.

The anti-reflection device 29 furthermore has a hollow cone 41 arranged in the base body 31 coaxially with the base body 31. The hollow cone 41, which may have an opening angle of 30° to 100°, improves the dampening of pressure waves entering the injector 1 through the fluid inlet portion 5.

To achieve this, the anti-reflection device 29 is arranged with the first base side 33 being oriented towards the fluid inlet portion 5 and the second base side 35 being oriented towards the fluid outlet portion 7.

When fuel enters the anti-reflection device 29, the flow is forced on the helically curving flow path 47. Thus, a rotating flow is generated. The rotating flow decouples the cavity 9 above the anti-reflection device 29 from the cavity 9 below the anti-reflection device 29. Furthermore, the rotation of flow would have to be stopped by a pressure wave which has been reflected in the injector 1 and propagates towards the fluid inlet portion 5. Stopping of the rotation of the flow, however, would dissipate energy. Thus, the propagation and the reflection of pressure waves inside the injector 1 are minimized.

FIG. 3 shows several views of an anti-reflection device 29 according to a second example. This example differs from the first example shown in FIG. 2 only in the form of the thread 43 formed on the circumferential surface 37. According to the second example, the walls 45 are thicker compared to the cross section of the flow path 47, thereby reducing the length of the flow path 47.

A number of implementations have been described. Nevertheless, it will be understood that various modifications may be made without departing from the spirit and scope of the disclosure. Accordingly, other implementations are within the scope of the following claims.

What is claimed is:

1. An anti-reflection device for preventing reflection of pressure waves inside a fuel injection valve, the anti-reflection device comprising:

a cylindrical base body with a first base side, a second base side and an outer surface;

a longitudinal axis orientated parallel to a propagation direction of a pressure wave, the longitudinal axis penetrating the first base side and the second base side; and a flow path for fuel formed between the first base side and the second base side, the flow path forming a curve around the longitudinal axis, wherein the cylindrical base body has a cylindrical inner section and an outer section comprising a helical wall formed on a circumferential surface of the cylindrical inner section and being arranged coaxially with the cylindrical inner section, the flow path formed by the circumferential surface of the cylindrical inner section and two adjacent turns of the helical wall.

2. The anti-reflection device according to claim 1, wherein the flow path has a form of a helical curve around the longitudinal axis.

3. The anti-reflection device according to claim 1, wherein the flow path has a cross-sectional area of 1 to 4 $mm^2$.

4. The anti-reflection device according to claim 1, wherein the cylindrical base body is formed of a plastic material.

5. The anti-reflection device according to claim 1, wherein the cylindrical base body is formed of a metal.

6. An anti-reflection device for preventing reflection of pressure waves inside a fuel injection valve, the anti-reflection device comprising:

a cylindrical base body with a first base side, a second base side and an outer surface;

a longitudinal axis orientated parallel to a propagation direction of a pressure wave, the longitudinal axis penetrating the first base side and the second base side; and a flow path for fuel formed between the first base side and the second base side, the flow path forming a curve around the longitudinal axis, wherein a hollow cone is formed in the cylindrical base body coaxially with the cylindrical base body and is oriented with its base plane forming a part of the first base side.

7. A fuel injection valve, comprising:

a valve body with a central longitudinal axis comprising a cavity with a fluid inlet portion and a fluid outlet portion;

a valve needle axially moveable in the cavity, the valve needle preventing a fluid flow through the fluid outlet portion in a closing position and releasing the fluid flow through the fluid outlet portion in further positions;

an electro-magnetic actuator unit designed to actuate the valve needle; and at least one anti-reflection device being arranged inside the cavity, the anti-reflection device comprising:

a cylindrical base body with a first base side, a second base side and an outer surface, the first base side being directed towards the fluid inlet portion;

a longitudinal axis orientated parallel to a propagation direction of a pressure wave, the longitudinal axis penetrating the first base side and the second base side; and a flow path for fuel formed between the first base side and the second base side, the flow path forming a curve around the longitudinal axis, wherein the base cylindrical body has a cylindrical inner section and an outer section comprising a helical wall formed on a circumferential surface of the cylindrical inner section and being arranged coaxially with the cylindrical inner section, the flow path formed by the circumferential surface of the cylindrical inner section and two adjacent turns of the helical wall.

8. The fuel injection valve according to claim 7, wherein the anti-reflection device is arranged upstream of an armature of the electro-magnetic actuator unit.

9. The fuel injection valve according to claim 7, wherein the anti-reflection device is press-fitted into an inlet tube of the valve body.

10. The fuel injection valve according to claim 7, wherein the flow path has a form of a helical curve around the longitudinal axis.

11. The fuel injection valve according to claim 7, wherein the flow path has a cross-sectional area of 1 to 4 $mm^2$.

12. The fuel injection valve according to claim 7, wherein the cylindrical base body is formed of a plastic material.

13. The fuel injection valve according to claim 7, wherein the cylindrical base body is formed of a metal.

14. A fuel injection valve, comprising:

a valve body with a central longitudinal axis comprising a cavity with a fluid inlet portion and a fluid outlet portion;

a valve needle axially moveable in the cavity, the valve needle preventing a fluid flow through the fluid outlet portion in a closing position and releasing the fluid flow through the fluid outlet portion in further positions;

an electro-magnetic actuator unit designed to actuate the valve needle; and at least one anti-reflection device being arranged inside the cavity, the anti-reflection device comprising:

a cylindrical base body with a first base side, a second base side and an outer surface, the first base side being directed towards the fluid inlet portion;

a longitudinal axis orientated parallel to a propagation direction of a pressure wave, the longitudinal axis penetrating the first base side and the second base side; and a flow path for fuel formed between the first base side and the second base side, the flow path forming a curve around the longitudinal axis, wherein a hollow cone is formed in the cylindrical base body coaxially with the cylindrical base body and is oriented with its base plane forming a part of the first base side.

* * * * *